US007013927B2

(12) United States Patent
Beaumont

(10) Patent No.: US 7,013,927 B2
(45) Date of Patent: Mar. 21, 2006

(54) SLEEVE FOR TOILET FLANGES AND DRAINS

(76) Inventor: Robert Beaumont, 34 Broad Oak Cr., Brampton, Ontario (CA) L6Y 3Y7

( * ) Notice: Subject to any disclaimer, the term of this patent is extended or adjusted under 35 U.S.C. 154(b) by 0 days.

(21) Appl. No.: 10/847,619

(22) Filed: May 18, 2004

(65) Prior Publication Data

US 2004/0231742 A1 Nov. 25, 2004

(30) Foreign Application Priority Data

May 23, 2003 (CA) ..... 2429407

(51) Int. Cl.
*F16L 9/18* (2006.01)

(52) U.S. Cl. ..... 138/113; 138/108; 138/114; 4/252.4; 249/142; 52/577

(58) Field of Classification Search ..... 138/111, 138/113, 112, 114, 110, 108, 148; 4/242.5, 4/242.4; 52/577; 249/142, 177
See application file for complete search history.

(56) References Cited

U.S. PATENT DOCUMENTS 2,270,286 A * 1/1942 Gerriets ..... 52/220.8
3,286,015 A * 11/1966 Hildebrand et al. ..... 174/29
3,419,288 A * 12/1968 Logsdon ..... 285/58
3,421,551 A 1/1969 Currier ..... 138/178
3,643,267 A * 2/1972 Winter ..... 4/252.4
3,789,129 A * 1/1974 Ditscheid ..... 174/28
3,800,486 A * 4/1974 Harvey ..... 52/98
3,823,744 A * 7/1974 Logsdon ..... 138/96 R
4,212,486 A * 7/1980 Logsdon ..... 285/4
4,329,744 A * 5/1982 Cuschera ..... 4/292
4,930,544 A * 6/1990 Ziu ..... 138/113
5,018,260 A * 5/1991 Ziu ..... 24/555
5,099,887 A 3/1992 Hooper ..... 138/89
5,190,320 A 3/1993 Hodges ..... 285/36
5,347,786 A * 9/1994 Hodges ..... 52/577

FOREIGN PATENT DOCUMENTS

CA 2026420 9/1990

* cited by examiner

*Primary Examiner*—Patrick Brinson
(74) *Attorney, Agent, or Firm*—Shoemaker and Mattare

(57) ABSTRACT

A protective sleeve system for use by plumbers during installation of riser pipes in buildings, surrounds a pipe and maintains a space around the pipe. A sleeve surrounds the pipe such that a space is defined between the pipe and the sleeve and a plurality of spacers disposed between the sleeve and the pipe, maintain the space between the pipe and the sleeve. The plurality of spacers are separate from the sleeve. An annular cover ring covers the annular space. In use, the protective sleeve system is installed prior to pouring the concrete floor. After pouring and setting of the concrete floor, the cover ring is removed, followed by the removal of the spacers. The sleeve is then cut to floor level and the pipe riser is cut down to a suitable level.

4 Claims, 3 Drawing Sheets

SLEEVE FOR TOILET FLANGES AND DRAINS

FIELD OF THE INVENTION

The present invention relates generally to plumbing and in particular to an apparatus for use with an upstanding pipe riser for maintaining a space around the pipe and a method of use thereof.

BACKGROUND OF THE INVENTION

In residential and commercial construction, drainpipes are used to direct waste from a sink, toilet or drain, into the sewer below. In order to locate a sink, toilet or drain on a concrete floor, a pipe riser is first installed prior to pouring of the concrete. The pipe riser, following the pouring of the concrete floor, usually extends several inches or more above the level of the floor. The level of the pipe riser is then brought even with the floor, or to a level which is somewhat recessed below the level of the floor. The final plumbing work is then completed.

In the case of a conventional toilet, shower drain, floor drain, and floor mounted clean out, an annular recess is required in the floor. The annular recess is concentric with the pipe riser, in order to provide a space for a water closet connecting collar to be secured to the upper end of the pipe.

The prior art includes a number of devices developed to reserve the annular recess about the pipe riser. These devices, however, tend to be relatively expensive and cumbersome. For example, U.S. Pat. No. 5,099,887, issued Mar. 31, 1992 to O. F. Hooper, discloses a collar for a pipe riser for maintaining an annular space about the periphery of the riser during the pouring of the floor. This construction involves inner and outer sleeves separated by a plurality of knock-out webs. The inner sleeve snugly receives the upper end of the riser, while the outer sleeve maintains an annular space about the riser. After the floor is poured and solidified, the webs are knocked out and the inner sleeve is removed along with the webs.

Another example of a prior art device is disclosed in U.S. Pat. No. 3,421,551, issued Jan. 14, 1969 to G. F. Currier. This patent is directed to a spacing sleeve for close fit about the upper end of an upright water closet drainpipe, to provide an annular recess about the pipe in a concrete floor. The sleeve is a one-piece right cylindrical member formed from a polystyrene expanded plastic foam which has a high compressive strength, will not absorb water, and is readily frangible or breakable. In use, after the floor has been poured, the inner portion of the frangible sleeve is compressed and broken away by hand, thereby clearing an annular cavity about the upper end of the pipe.

Still another example is shown in Canadian Patent No. 2,026,420, issued Nov. 26, 1996 to D. K. Pollard. This patent discloses a sleeve that is placed over and cemented to a pipe end. The sleeve is complex-shaped and it involves time-consuming and complex installation.

In view of the complexity of the collar disclosed in U.S. Pat. No. 5,099,887, the easily damaged nature of the collar disclosed in U.S. Pat. No. 3,421,551, and the complexity of the shape and installation of the sleeve disclosed in Canadian Patent No. 2,026,420, there is a need for a simple, recess-reserving device of sufficient strength for use in maintaining a space around a pipe riser.

SUMMARY OF THE INVENTION

In one aspect of the present invention, there is provided a protective sleeve system for surrounding a pipe and maintaining a space around the pipe. The system includes a sleeve for surrounding the pipe such that a space is defined between the pipe and the sleeve. A plurality of spacers maintain the space between the pipe and the sleeve, the plurality of spacers being separate from the sleeve.

In another aspect of the present invention, there is provided a method of maintaining a space around the pipe. In accordance with this method, a sleeve is disposed around the pipe such that a space is defined between the pipe and the sleeve, prior to pouring a concrete floor. A plurality of spacers are inserted between the pipe and the sleeve for maintaining the space prior to pouring the concrete floor and the spacers are removed after pouring and setting of the floor.

Advantageously, different types of plumbing fittings with hubs can be installed using embodiments of the present invention. The sleeve of the present invention protects the riser pipe from concrete, while concrete is being poured. The sleeve does not attach to any part of the plumbing system nor does it effect the plumbing system in any way. The simple and easy construction of the sleeve reduces installation time and expense during plumbing rough-in and finishing stages. The present invention provides an annular space between the pipe and the sleeve. Thus, the present invention can be used wherever concrete is being poured on a floor or wall. Further, the present invention can be used with different types of plumbing piping material, such as, plastic, copper, cast iron, glass or steel. Thus, the present invention provides simplicity and versatility in use in plumbing applications.

In one aspect of the present invention, flooring around the toilet area can be finished prior to installation of a water closet flange to a finished floor.

BRIEF DESCRIPTION OF THE DRAWINGS

The invention will be better understood with references to the following drawings in which like numerals denote like parts throughout, and in which.

DETAILED DESCRIPTION OF THE PREFERRED EMBODIMENTS

Figure 1A:
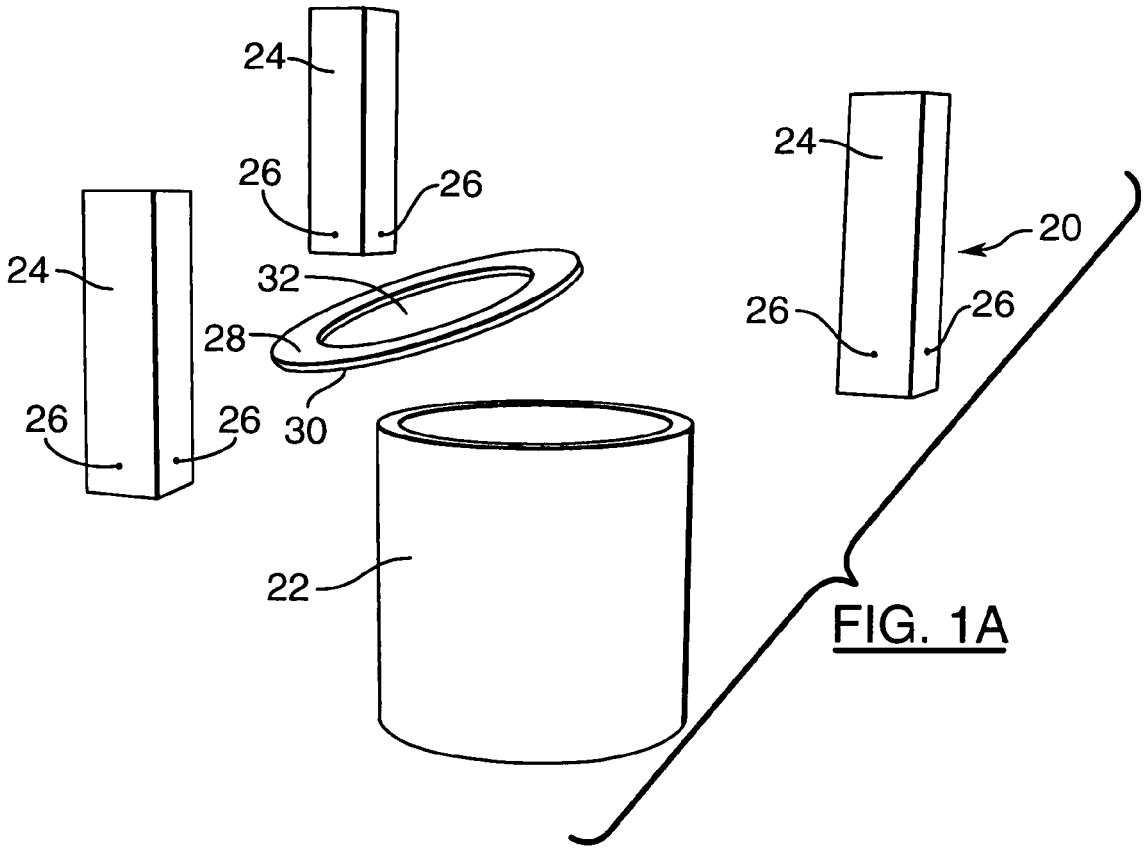
FIG. 1A is an exploded view of components of a protective sleeve system according to an embodiment of the present invention.

Reference is first made to FIG. 1A to describe a preferred embodiment of a protective sleeve system for surrounding a pipe and maintaining a space around a pipe indicated generally by the numeral 20. The system includes a generally cylindrical sleeve 22 for surrounding the pipe such that a space is defined between the pipe and the sleeve 22. A plurality of spacers 24 maintain the space between the pipe and the sleeve 22. As shown, the spacers 24 are separate from the sleeve 22.

The protective sleeve system 20 will now be described in more detail. The protective sleeve system 20 includes the sleeve 22, which is a hollow, generally cylindrical sleeve that extends approximately 12" (30.5 cm). Each of the plurality of spacer bars is hollow, is about 12" (30.5 cm) long and includes opposed, flat, generally parallel side walls 26. The system 20 also includes an annular cover ring 28 that has an external periphery 30 equal to or slightly greater than the outer periphery of the sleeve 22. The cover ring 28 has an inner opening 32 sized and shaped to slidingly receive a pipe riser. Each of the elements of the system 20 is constructed of a suitable material such as cardboard or plastic.

Figure 1B:
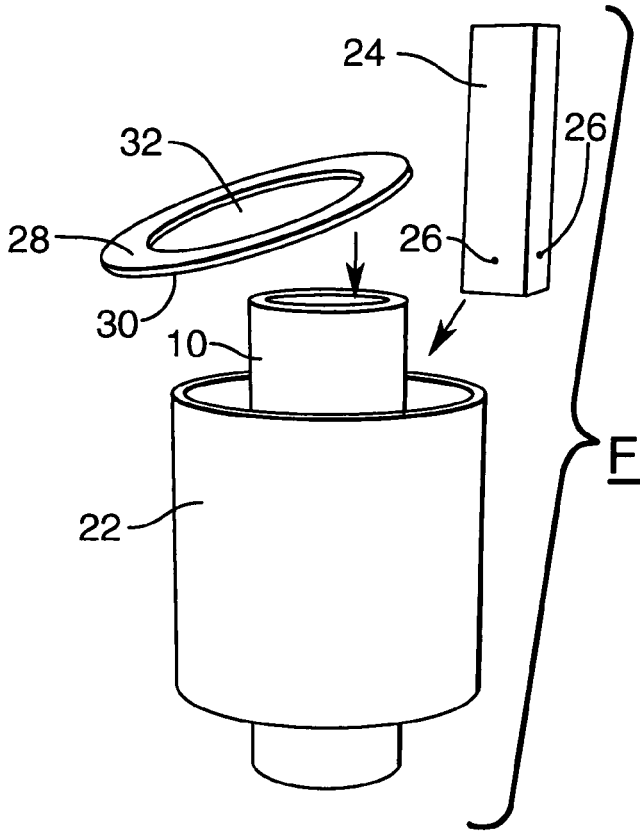
FIG. 1B is a partly exploded perspective view of a top end of a pipe riser, along with main components of the protective sleeve system of FIG. 1.

Referring now to FIG. 1B, there is shown a pipe riser 10 (also referred to as a pipe) suitable for use with a toilet. As can be seen, the pipe 10 has an open upper end, passes through a floor support 14 and connects eventually with a standard 3" (about 7.62 cm) or 4" (about 10.2 cm) plumbing pipe (not illustrated) for carrying waste materials to a sewer, septic tank, or the like. The floor support 14 also represents other possibilities, for example, where the concrete floor is to be poured directly on grade. Thus, the layer 14 is intended to represent any generally flat supporting surface.

Figure 2:
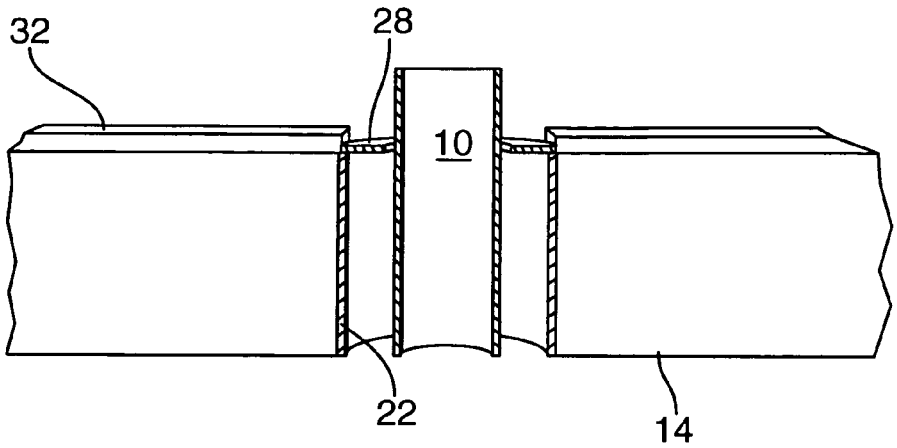
FIG. 2 is a vertical sectional view through the axis of the pipe riser, illustrating the protective sleeve system of FIG. 1, in place after a floor has been poured.
Figure 3:
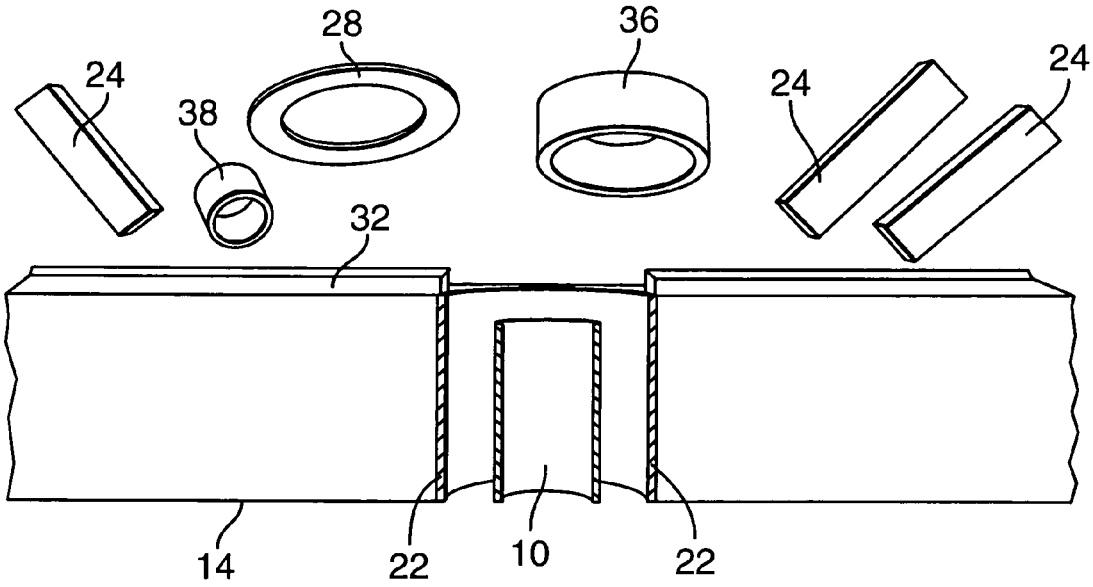
FIG. 3 is a view similar to FIG. 2, but subsequent to removal and cutting away of portions and components of the protective sleeve system.

Prior to the pouring of the concrete floor 16, shown in FIGS. 2 and 3, the sleeve 22 is placed around the pipe 10 and rests on the support 14. The plurality (typically 3 or 4) of spacers 24 are inserted between the pipe 10 and the sleeve 22. The width of each spacer bar 24 is similar such that, when the spacer bars 24 are in place between the pipe 10 and the sleeve 22, the pipe 10 and the sleeve 22 are generally concentric.

Figure 4:
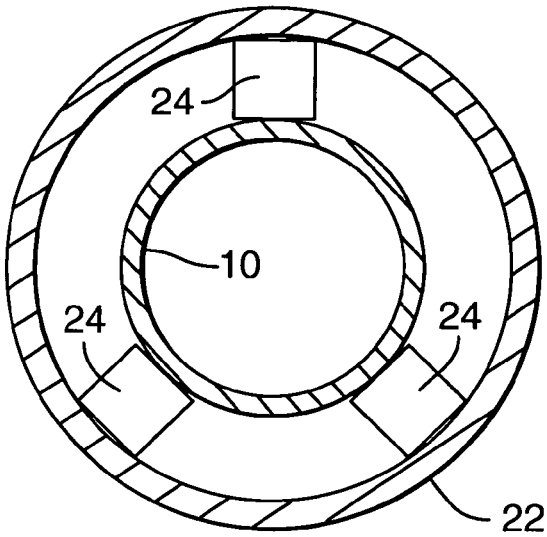
FIG. 4 is a horizontal sectional view of the protective sleeve system of FIG. 2.

Once the sleeve 22 is positioned about the pipe 10 and the spacers 24 are located between the sleeve 22 and the pipe 10, the cover ring 28 is placed in position around the pipe 10, as shown in FIGS. 2 and 4. The spacer ring 28 protects the annular space between the sleeve 22 and the pipe 10 and inhibits sand, gravel or concrete from entering the annular space.

The concrete is then poured to form the floor 16 (see FIG. 2). Concrete floors are typically 4" (about 10.2 cm) to 10" (about 25.4 cm) since the sleeve 22 is 12" (about 30.5 cm), the sleeve extends at least 2" (about 5.5 cm) from the concrete floor surface.

When the concrete of the floor 16 is set, the floor finishing is installed and the cover ring 28 is removed. Typical floor finishings include ceramic tile, vinyl flooring, carpet or wood flooring. The spacer bars 24 are then removed. Next, the sleeve 22 is cut to the level of the finished floor 32, the level being indicated by the numeral 32. Following this, the pipe 10 is cut to a level of about ½" (about 1.3 cm) below the floor level 32, using a standard inside pipe cutter. The removed upper end of the sleeve 22, which is cut away during the installation procedure, is indicated by the numeral 36 in FIG. 3. The top end of the pipe 10 which is cut to a level below the top of the cut sleeve 22, is indicated by the numeral 38 in FIG. 3.

Figure 5A:
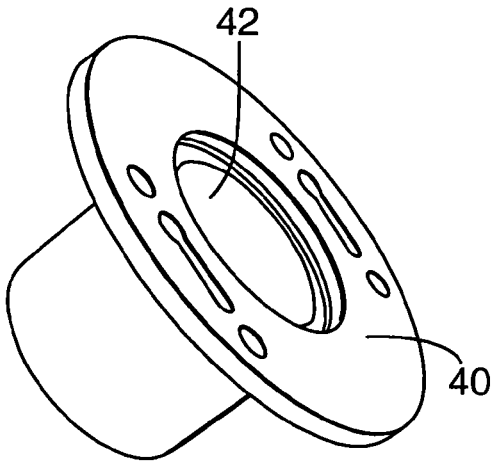
FIG. 5A is a perspective view of a toilet flange for installation on a pipe riser, using the protective sleeve system of FIG. 1.
Figure 5B:
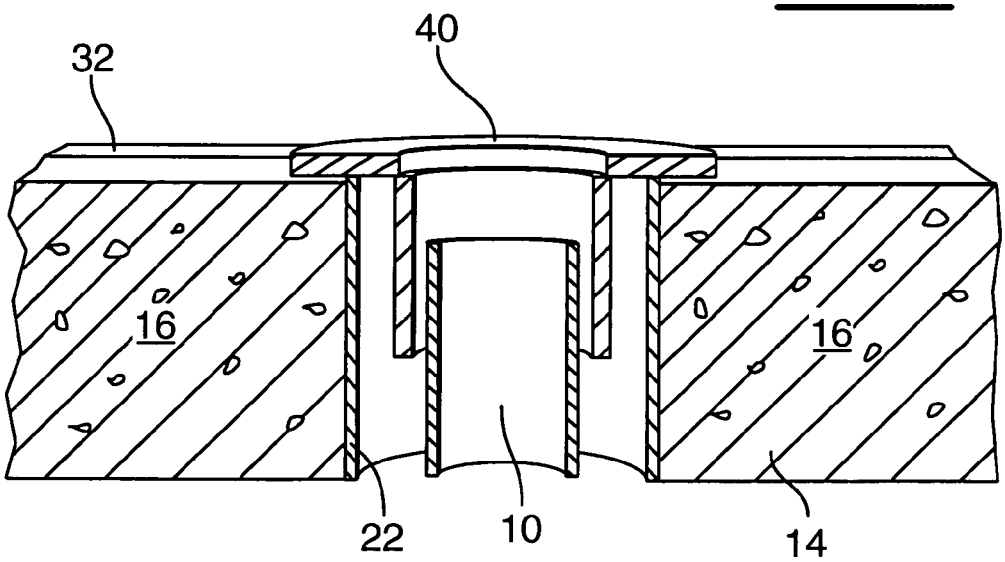
FIG. 5B is a vertical sectional view of the toilet flange of FIG. 4, installed using the protective sleeve system of FIG. 1, subsequent to the removal and cutting away of portions of the protective sleeve system.

The foregoing procedure permits a hub of a toilet flange 40, as best shown in FIG. 5A, to be installed at floor level and fastened in place to the pipe 10, as shown in FIG. 5B. The toilet flange 40 includes an inner groove 42 and is sized and shaped to receive the pipe 10 and to be secured thereto. As it will be understood by those skilled in the art, the toilet flange 40 is fastened to the finished floor 32.

It has been determined that it takes only a matter of seconds for a single workperson to install the sleeve 22, the spacer bars 24 and the cover ring 28 at each pipe riser location, without requiring the use of high cost equipment. Also, the sleeve 22 and the pipe riser are easily cut for the installation of the toilet flange.

While one embodiment of this invention has been illustrated in the accompanying drawings and described hereinabove, it will be evident to those skilled in the art that changes and modifications may be made therein without departing from the essence of the invention. For example, the above description relates to the use of the sleeve system for use in maintaining a space around a pipe for a toilet flange. Other similar applications are possible, including, use in many types of different plumbing applications including floor drains, floor or wall mounted water closet flanges, shower drains, etc. Also, the size and shape of many of the components can change while still performing the same function.

It is well known in the industry that a poured concrete floor around a floor drain is contoured so that it slopes down generally uniformly toward the drain. It will be understood that the plumber can indicate the specific pipes which will constitute floor drains to the concrete finisher, simply by using a particular color for the sleeve 22 which is intended to identify such a drain.

Still other modifications and variations may be possible. All such modifications and variations are believed to be within the scope and sphere of the present invention.

What is claimed is:

1. A protective sleeve system for surrounding a pipe and maintaining a space around the pipe, the system comprising:

a hollow, generally cylindrical sleeve having a central longitudinal axis and surrounding the pipe such that a space is defined between said pipe and said sleeve; and a plurality of straight, elongate spacer bars placed between said pipe and said sleeve at circumferentially spaced locations, said spacer bars extending generally parallel to the central longitudinal axis of said sleeve and maintaining said space between said pipe and said sleeve such that said sleeve is generally concentric with said pipe, wherein said plurality of spacers are separate from said sleeve and are removable from said space independent of said sleeve.

2. The protective sleeve system according to claim 1, further comprising an annular cover ring for covering said space between said pipe and said sleeve for protecting said space.

3. The protective sleeve system according to claim 1 wherein each of said spacers is generally square in cross-section.

4. The protective sleeve system according to claim 3 wherein each of said spacers is formed of cardboard or plastic.

* * * * *